US008053034B1

(12) United States Patent
Dickinson et al.

(10) Patent No.: US 8,053,034 B1
(45) Date of Patent: Nov. 8, 2011

(54) HIGH PERFORMANCE TANK SYSTEMS

(76) Inventors: Colin Dickinson, Peoria, AZ (US); Penny Dickinson, Peoria, AZ (US); Robert N. Mundell, New River, AZ (US); Michael A. Maddux, Tolleson, AZ (US); Jess Noble, Mesa, AZ (US)

( * ) Notice: Subject to any disclaimer, the term of this patent is extended or adjusted under 35 U.S.C. 154(b) by 329 days.

(21) Appl. No.: 12/388,887

(22) Filed: Feb. 19, 2009

Related U.S. Application Data

(60) Provisional application No. 61/029,852, filed on Feb. 19, 2008, provisional application No. 61/138,849, filed on Dec. 18, 2008.

(51) Int. Cl.
*B05D 1/18* (2006.01)

(52) U.S. Cl. ..... 427/435; 427/430.1

(58) Field of Classification Search ..... 220/563; 427/435, 430.1, 327, 328, 329, 330; 118/400, 118/423, 428, 429, DIG. 13
See application file for complete search history.

(56) References Cited

U.S. PATENT DOCUMENTS

| | | | | |
|---|---|---|---|---|
| 792,028 | A | 6/1905 | Harker | |
| 1,101,878 | A | 6/1914 | Newbert | |
| 1,682,403 | A | 8/1928 | Murray | |
| 2,186,285 | A | 1/1940 | Eickmeyer | |
| 2,237,259 | A | 4/1941 | Marland | |
| 2,238,102 | A * | 4/1941 | Eisinga | 220/565 |
| 2,412,271 | A | 12/1946 | Kercher | |
| 2,477,684 | A | 8/1949 | Borg et al. | |
| 2,520,658 | A | 8/1950 | Rheem et al. | |
| 2,694,018 | A | 11/1954 | Gehnrich | |
| 2,806,622 | A * | 9/1957 | Leirer | 220/4.14 |
| 2,970,719 | A | 2/1961 | Brady | |
| 3,635,182 | A * | 1/1972 | Paffett | 114/267 |
| 3,671,412 | A * | 6/1972 | Lohr | 204/481 |
| 3,699,918 | A * | 10/1972 | Garrison | 118/54 |
| 3,936,540 | A * | 2/1976 | James | 427/310 |
| 4,251,005 | A * | 2/1981 | Sons et al. | 220/563 |
| 6,557,233 | B1 | 5/2003 | Rösch | |
| 6,802,430 | B2 * | 10/2004 | Tomimura et al. | 220/562 |
| 7,316,229 | B2 * | 1/2008 | Jaye | 126/360.2 |

* cited by examiner

*Primary Examiner* — Stephen Castellano

(74) *Attorney, Agent, or Firm* — Stoneman Law Patent Group; Martin L. Stoneman

(57) ABSTRACT

The high performance tank systems relate to producing efficient, inexpensive, durable corrosion proof galvanized mild-steel tanks for transporting fluids on land transport vehicles. The tanks can be used to transport fluids of many types. Due too the annealing process used the tanks are stress relieved and less prone to fractures.

8 Claims, 12 Drawing Sheets

HIGH PERFORMANCE TANK SYSTEMS

CROSS-REFERENCE TO RELATED APPLICATION

The present application is related to and claims priority from prior provisional application Ser. No. 61/029,852, filed Feb. 19, 2008, entitled "HIGH-PERFORMANCE TANK SYSTEMS"; and, this application is related to and claims priority from prior provisional application Ser. No. 61/138,849, filed Dec. 18, 2008, entitled "HIGH-PERFORMANCE TANK SYSTEMS", the contents of both of which are incorporated herein by this reference and are not admitted to be prior art with respect to the present invention by the mention in this cross-reference section.

BACKGROUND

This invention relates to providing a system for improved high performance tank systems. More particularly this invention relates to providing a system for manufacturing large tanks used in the transportation of fluids. Stainless steel as a tank material is a quality option providing durable and corrosion resistant characteristics; however, it is very expensive and is prone to problems if welding procedures are not performed correctly.

Plastic tanks are lightweight and inexpensive; however plastic is not found to be as durable in this specific application. Plastic can undergo degradation from ultra violet sunlight and from rough handling that may lead to compromises in the tank's integrity and resulting in leaks. Plastic tanks typically have a shorter life span expectancy than metal tanks making them an unattractive option.

OBJECTS AND FEATURES OF THE INVENTION

A primary object and feature of the present invention is to provide a system overcoming the above-mentioned problems.

It is a further object and feature of the present invention to provide such a tank system that is galvanized.

It is another further object and feature of the present invention to provide an tank assembly process that is less expensive than assembling a stainless steel tank.

It is yet another object and feature of the present invention to provide a tank that is long lasting, corrosion resistant, durable, and substantially maintenance free.

It is yet a further object and feature of the present invention to reduce deformation of large tanks during the hot-dip galvanizing process.

It is another object and feature of the present invention to optimize the volume of galvanizing solution used to plate each tank.

It is yet another object and feature of the present invention to provide a mild-steel tank that is stress relieved and less prone to stress fractures.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides an apparatus, relating to the bulk vehicular transport of fluids, comprising: at least one fluid-transport tank structured and arranged to assist tank-transporting of the fluids; wherein such at least one fluid-transport tank comprises at least one fluid-containment shell comprising at least one substantially enclosed interior portion structured and arranged to interiorly contain the fluids therein; wherein such at least one substantially enclosed interior portion comprises at least one front containment surface structured and arranged to provide front boundary containment of the fluids, at least one rear containment surface structured and arranged to provide rear boundary containment of the fluids, extending substantially between such at least one front containment surface and such at least one rear containment surface, at least one intermediate containment surface structured and arranged to provide intermediate interior boundary containment of the fluids, a primary longitudinal axis oriented to intersect both such at least one front containment surface and such at least one rear containment surface, inwardly-extending from such at least one intermediate containment surface, at least one transverse surge-control baffle structured and arranged to control surging movement of the liquid in a direction generally parallel to such primary longitudinal axis, and at least one structural stabilizer structured and arranged to structurally stabilize such at least one longitudinal surge-control baffle during such transverse movements of the liquid; wherein such at least one structural stabilizer comprises at least one structural coupler structured and arranged to structurally couple such at least one transverse surge-control baffle to at least one of such at least one front containment surface and such at least one rear containment surface, wherein such at least one structural coupler comprises at least one longitudinal surge-control surface structured and arranged to control surging movements of the liquid in a direction generally perpendicular to such primary longitudinal axis, and at least one stiffener structured and arranged to stiffen such at least one longitudinal surge-control surface; and wherein such at least one stiffener comprises at least one obtuse-extender to obtusely-extend from at least one surface plane of such at least one longitudinal surge-control surface at least one substantially obtuse angle from such at least one surface plane.

Moreover, it provides such an apparatus wherein such at least one structural coupler further comprises: at least one web plate structured and arranged to provide such at least one surface plane; wherein such at least one web plate comprises at least one first substantially planar side at least one second substantially planar side; wherein such at least one obtuse-extender comprises projecting at such at least one substantially obtuse angle from such at least one first substantially planar side, at least one first flange plate structured and arranged to structurally stiffen at least one first edge portion of such at least one web plate, and projecting at such least one substantially obtuse angle from at such at least one second substantially planar side, at least one second flange plate structured and arranged to stiffen at least one second edge portion of such at least one web plate.

Additionally, it provides such an apparatus wherein such at least one first flange plate and such at least one second flange plate extend substantially along an entire linear length of such at least one web plate. Also, it provides such an apparatus wherein such at least one substantially obtuse angle of such at least one first flange plate and such at least one substantially obtuse angle of such at least one second flange plate each comprises an angle measurement of about 135 degrees relative to such at least one surface plane of such at least one web plate. In addition, it provides such an apparatus wherein: at least one portion of such at least one web plate, such at least one first flange plate, and such at least one second flange plate comprise members of at least one common structural element; wherein such at least one common structural element comprises at least one bent plate. And, it provides such an apparatus wherein such at least one structural coupler is structured and arranged to structurally couple such at least one transverse surge-control baffle to both such at least one front containment surface and such at least one rear containment surface.

Further, it provides such an apparatus wherein: such at least one front containment surface comprises at least one front-containment wall structured and arranged to provide front-wall containment of the fluids; such at least one rear containment surface comprises at least one rear-containment wall structured and arranged to provide rear-wall containment of the fluids; such at least one front-containment wall comprises at least one load-distributing reinforcer; such at least one rear-containment wall comprises at least one load-distributing reinforcer; such at least one structural coupler is coupled to such at least one front-containment wall and such at least one rear-containment wall substantially through such at least one load-distributing reinforcer.

Even further, it provides such an apparatus wherein such at least one liquid-containment shell further comprises: at least one first passage structured and arranged to assist passage of at least one protective dip-coating to within such at least one substantially enclosed interior portion during at least one dip-coating process; and at least one second passage structured and arranged to vent atmosphere displaced from within such at least one substantially enclosed interior portion during entry of the at least one protective dip-coating into such at least one liquid-containment shell during the at least one dip-coating process. Moreover, it provides such an apparatus wherein such at least one liquid-containment shell further comprises such at least one protective dip-coating structured and arranged to protectively coat such at least one substantially enclosed liquid-containment shell.

Additionally, it provides such an apparatus wherein such at least one liquid-containment shell substantially comprises steel; and such at least one protective dip-coating substantially comprises at least one hot-dipped zinc galvanization. Also, it provides such an apparatus wherein such at least one front containment surface comprises at least one of such at least one first passage and such at least one second passage; and such at least one rear containment surface comprises at least one of such at least one first passage and such at least one second passage.

In addition, it provides such an apparatus wherein such at least one intermediate containment surface comprises at least one of such at least one first passage and such at least one second passage. And, it provides such an apparatus wherein: such at least one transverse surge-control baffle comprises at least one transverse stiffener structured and arranged to stiffen such at least one transverse surge-control baffle; such at least one transverse stiffener comprises at least one transverse channel integrally formed within such at least one transverse surge-control baffle; and such at least one transverse channel extends substantially continuously across at least one transverse width of such at least one transverse surge-control baffle.

Further, it provides such an apparatus wherein: such at least one transverse surge-control baffle comprises at least one primary surface plane structured and arranged to control such surging movements of the liquid; such at least one transverse channel comprises, integrally formed within such at least one surface plane at least one offset channel wall structured and arranged to be offset from such at least one primary surface plane, extending substantially continuously from a first transverse edge of such at one offset channel wall, at least one first channel side wall, extending substantially continuously from a second transverse edge of such at one offset channel wall, at least one second channel side wall, such at least one first channel side wall and such at least one second channel sidewall are each oriented at an obtusely-extending angle relative to such at least one primary surface plane. Even further, it provides such an apparatus wherein such at least one transverse surge-control baffle comprises at least one attacher structured and arranged to attach such at least one transverse surge-control baffle to interior of such at least one intermediate containment surface.

In accordance with another preferred embodiment hereof, this invention provides a method, relating to dip-coating of at least one fluid-transport tank having fluid-shedding baffles that do not substantially retain fluid, comprising the steps of: providing at least partial immersion of such at least one fluid-transport tank in at least one dip-coating-fluid; providing for flow of such at least one dip-coating-fluid in to and out of such at least one fluid-transport tank; wherein uniform flow of such at least one dip-coating-fluid is assisted by such at least one fluid-transport tank comprising such fluid-shedding baffles; and whereby such at least one dip-coating-fluid is less impeded by the presence of such fluid-shedding baffles. Even further, it provides such a method wherein: such at least one fluid-transport tank is constructed substantially from at least one steel material; and such at least one steel material of such at least one fluid-transport tank comprises at least one substantially continuous galvanized surface after such step of providing such at least partial immersion of such at least one fluid-transport tank in such at least one dip-coating-fluid.

Even further, it provides such a method further comprising the step of completing welding of such at least one fluid-transport tank prior to the step of providing such at least partial immersion of such at least one fluid-transport tank in such at least one dip-coating-fluid. Even further, it provides such a method further comprising the step of annealing such at least one steel material to increase ductility. Furthermore, it provides such a method wherein: the step of annealing such at least one steel material to increase ductility occurs during such at least partial immersion of such at least one fluid-transport tank in such at least one dip-coating-fluid; and such at least one dip-coating-fluid comprises molten zinc.

Even further, it provides such a method wherein such at least one dip-coating-fluid comprises a temperature of at least about 460° Centigrade. Even further, it provides such a method wherein the step of providing for flow of such at least one dip-coating-fluid in to and out of such at least one fluid-transport tank further comprises the step of providing within such at least one fluid-transport tank, at least one fluid-transfer aperture structured and arranged to pass such at least one dip-coating-fluid into and out of such at least one fluid-transport tank and at least one pressure-equalization vent structured and arranged to promote the equalization of pressure between an interior of and an exterior of such at least one fluid-transport tank during such at least one partial immersion.

Moreover, it provides such a method further comprising the step of providing at least one reinforced lift point structured and arranged to assist reinforced lifting of such at least one fluid-transport tank during such at least partial immersion.

In accordance with another preferred embodiment hereof, this invention provides a fluid transport system comprising: fluid-transport tank means for tank-transporting of a fluid; wherein such fluid-transport tank means comprises interior-surface means for providing at least one tank-interior surface; wherein such fluid-transport tank means further comprises inwardly-extending baffle means, having at least one plane, for inwardly-extending baffling of the fluids; wherein such inwardly-extending baffle means comprises attacher means for attaching such inwardly-extending baffle means with such interior-surface means; wherein such inwardly-extending baffle means further comprises inwardly-extending stiffener means for stiffening such inwardly-extending baffle means; and wherein such inwardly-extending stiffener means comprises obtuse-extender means for obtusely-extending from such at least one plane of such inwardly-extending baffle means at least one substantially obtuse angle from such at least one plane. And it provides for each and every novel feature, element, combination, step and/or method disclosed or suggested by this patent application.

DETAILED DESCRIPTION OF THE BEST MODES AND PREFERRED EMBODIMENTS OF THE INVENTION

Transportation demand of bulk fluids has created a need for the use of large tanks that are mounted on trucks to move fluid products between destinations. The material used to manufacture the tank preferably should not change the material properties of the fluid being transported to avoid creating a danger for consumers of such product. Storage tanks presently used for transporting bulk fluids are expensive, and may not provide adequate durability or cost-effectiveness for their users.

Figure 1:
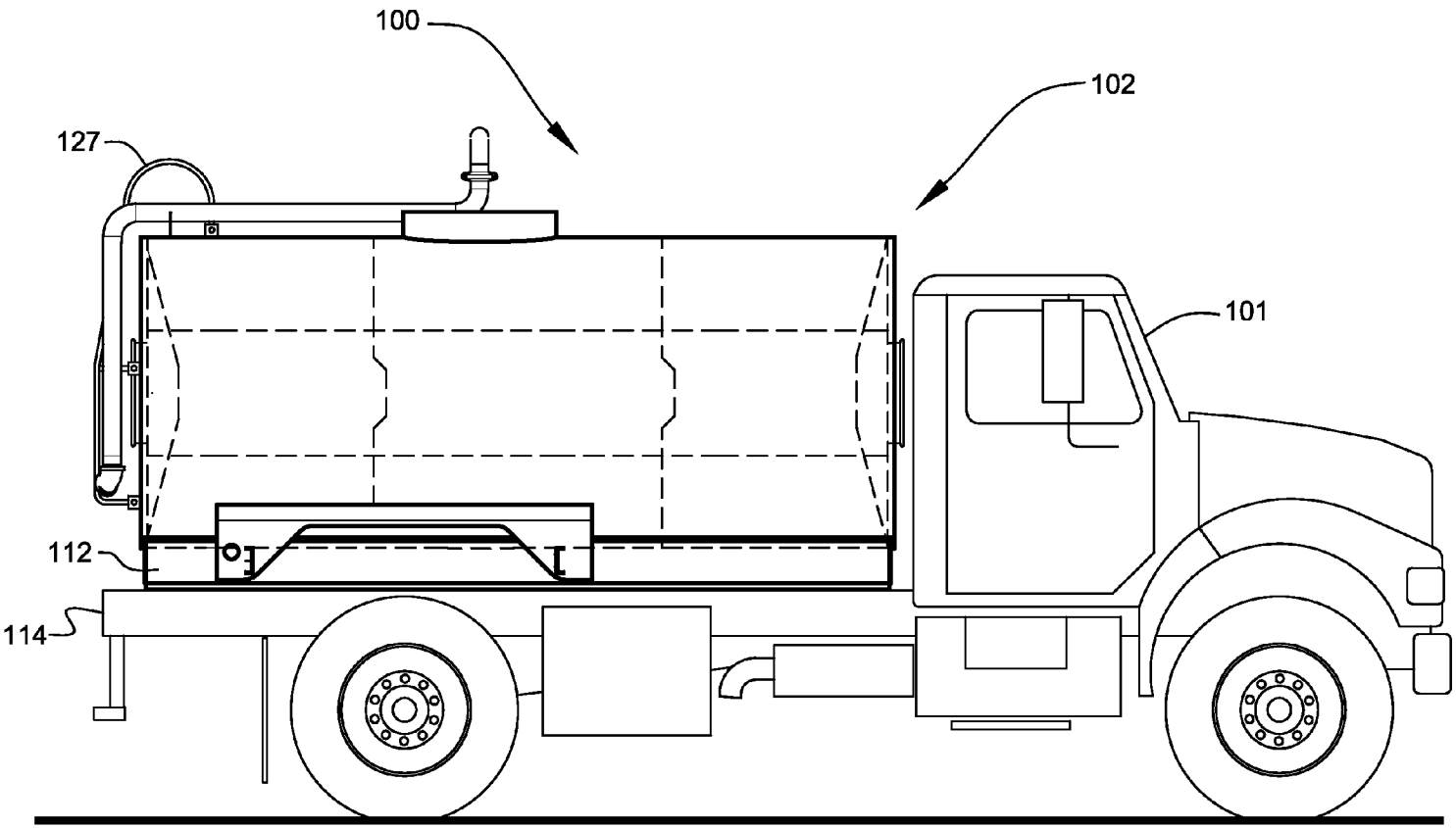
FIG. 1 is a side view illustrating a tank system, for use in transporting bulk fluids, according to a preferred embodiment of the present invention.

FIG. 1 is a side view illustrating tank system 100, for use in transporting bulk fluids, according to a preferred embodiment of the present invention. Tank system 100 preferably comprises at least one tank 102 (at least herein embodying at least one fluid-transport tank structured and arranged to assist tank-transporting of the fluids) preferably comprising at least one supportive subframe 112. Subframe 112 is preferably mounted onto at least one supportive frame rail 114 of transport vehicle 101, as shown.

Figure 12:
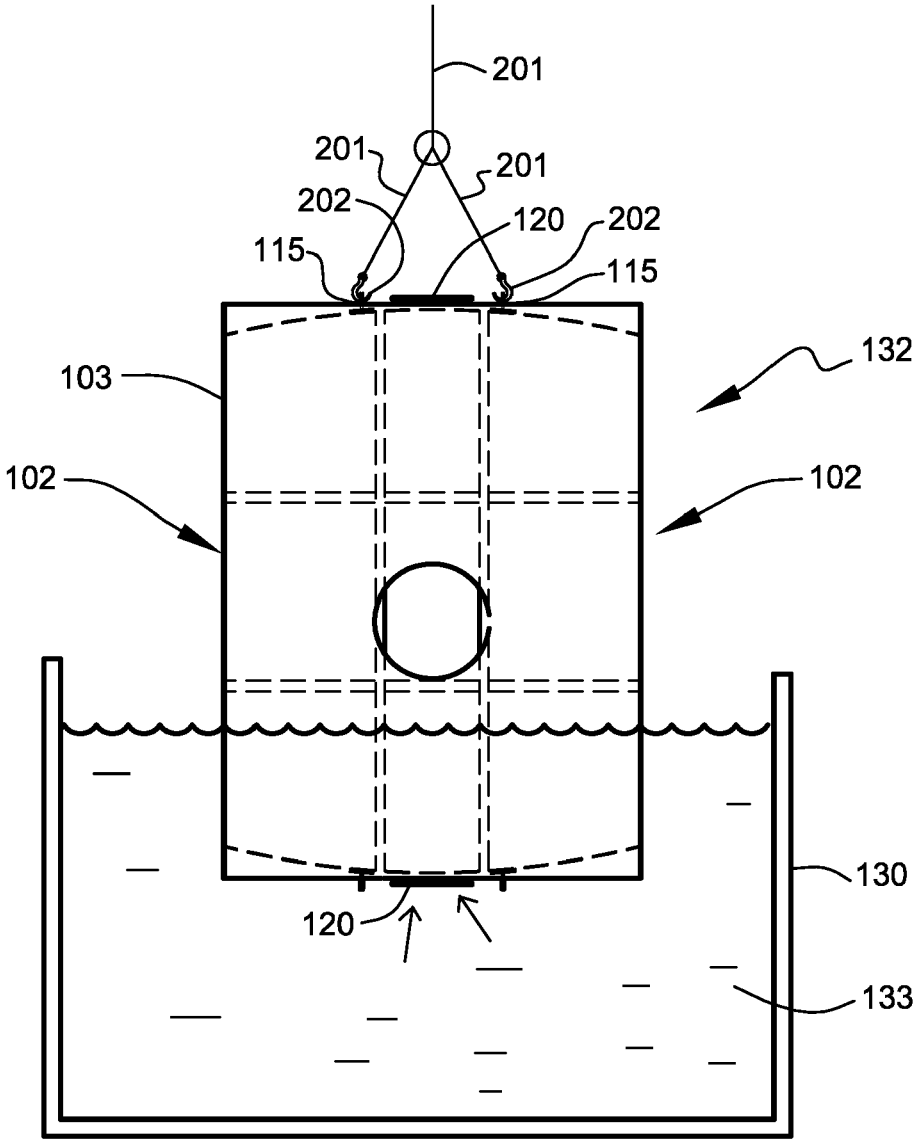
FIG. 12 illustrates a hot-dip galvanizing process of the tank, according to the preferred embodiment of FIG. 1.

Tank 102 is assembled out of mild steel parts, preferably of 3/16-inch material, preferably by at least one thermal welding process, preferably before tank 102 is hot-dip galvanized using the hot-dip galvanizing process 132 described in FIG. 12 (at least herein embodying the step of completing welding of such at least one fluid-transport tank prior to the step of providing such at least partial immersion of such at least one fluid-transport tank in such at least one dip-coating-fluid). Upon reading the teachings of this specification, those of ordinary skill in the art will now understand that, under appropriate circumstances, considering such issues as size/volume of tank, intended use, material advances, etc., other metal thicknesses, such as, 1/8-inch, 1/4-inch, etc., may suffice.

Tank 102 is preferably welded to subframe 112, which preferably runs lengthwise along the bottom of tank 102, as shown. Subframe 112 preferably comprises a pair of "U"-shaped channels preferably configured so as to provide maximum supportive contact with the frame rails 114 of the chassis of transport vehicle 101, as shown. Subframe 112 is preferably continuously (100-percent) welded to tank 102 preferably on both sides.

Subframe 112 of tank 102 is preferably fastened to frame rails 114 of transport vehicle 101, preferably welded, preferably providing sufficient strength to hold the weight of tank 102 when filled to its maximum capacity. Alternately preferably, subframe 112 of tank 102 is preferably fastened to frame rails 114 by mechanically fastening, preferably by bolted connections.

Figure 2:
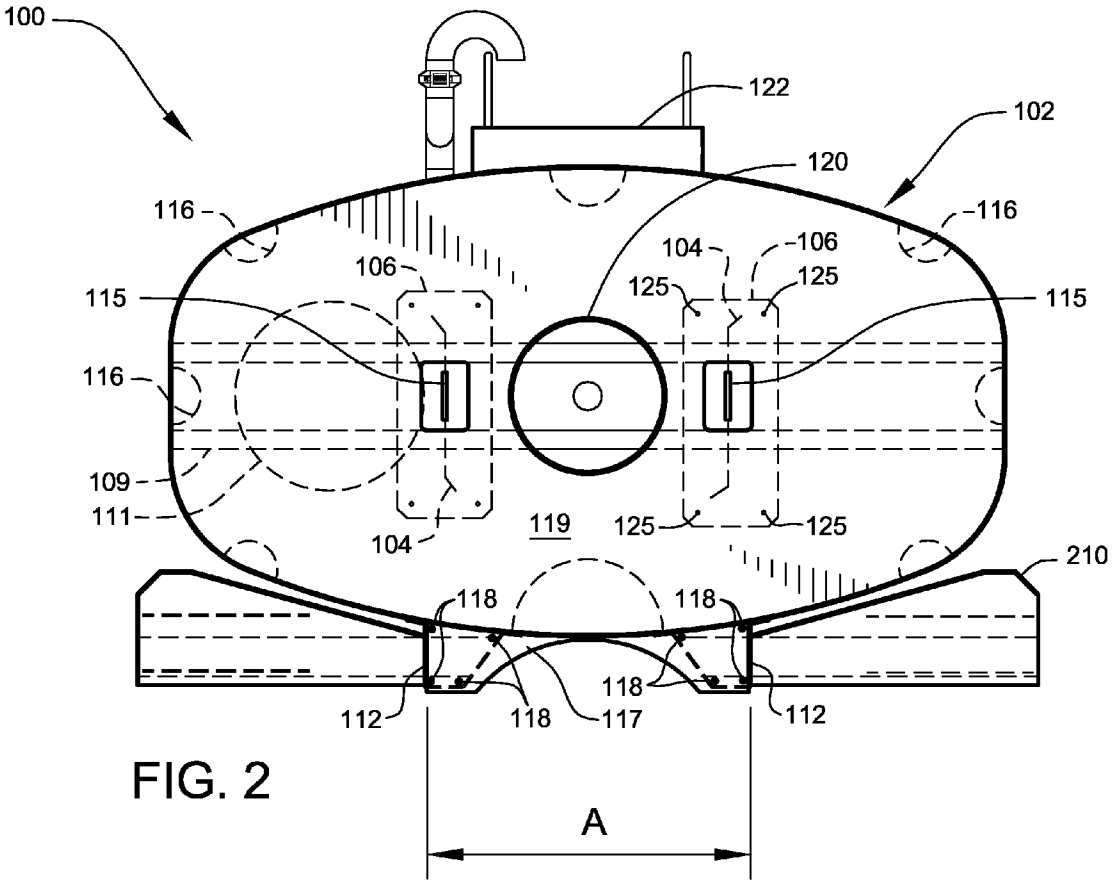
FIG. 2 shows a front view, illustrating a front head of a tank, according to the preferred embodiment of FIG. 1.

FIG. 2 shows a front view, illustrating front head 119 of tank 102, according to the preferred embodiment of FIG. 1. Front head 119 (at least herein embodying at least one front containment surface structured and arranged to provide front boundary containment of the fluids) preferably comprises at least one vent 120, at least one lifting lug 115, and at least one appurtenance pad 106, as shown. The peripheral edges of appurtenance pads 106 are preferably continuously welded preferably onto the interior face of front head 119 preferably by thermal weld 184 (see FIG. 6). Appurtenance pads 106 preferably function as reinforcement of front head 119 preferably at the points of attachment of lifting lugs 115 and longitudinal baffles 104 (at least herein embodying wherein such at least one front-containment wall comprises at least one load-distributing reinforcer).

Lifting lugs 115 are preferably continuously welded preferably to the outside face of front head 119. Appurtenance pads 106 preferably reinforces front head 119 preferably at the point of attachment of longitudinal baffles 104 preferably on the interior side of front head 119. Longitudinal baffles 104 (at least herein embodying at least one longitudinal surge-control surface structured and arranged to control surging movements of the liquid in a direction generally perpendicular to such primary longitudinal axis) preferably controls liquid surges preferably in the transverse direction. Each appurtenance pad 106 preferably comprises at least one weep hole 125 preferably allowing for air expansion between appurtenance pad 106 and front head 119, as shown. Weep holes 125 are preferably about ½ inch in diameter. Vent 120 (at least herein embodying wherein such at least one front containment surface comprises at least one of such at least one first passage and such at least one second passage) preferably allows galvanizing solution 133 (see FIG. 12) to preferably enter and preferably exit tank 102 during hot-dip galvanizing process 132 (at least herein embodying at least one first passage structured and arranged to assist passage of at least one protective dip-coating to within such at least one substantially enclosed interior portion during at least one dip-coating process). Lifting lugs 115 provide preferred hooking points to preferably allow lifting of tank 102 during hot-dip galvanizing process 132.

The maximum width of front head 119 is preferably maintained within the legal width limits for road-going vehicles in the jurisdiction in which the tank-bearing vehicle is operated. For the preferred example embodiment of FIG. 1, having an interior volume of about 2000 U.S. gallons, front head 119 preferably comprises a width of about 88 inches and a preferred height of about 50 inches. It is noted that preferred embodiments of tank system 100 preferably comprise alternate preferred widths, heights, lengths, and volumes.

The diameter of vent 120 is preferably approximately 16 inches for a tank volume of preferably approximately 252 cubic feet. As tank 102 volume increases, the diameter of vent 120 preferably also proportionately increase. Vent 120 is preferably capped with a preferably smooth plate, preferably corrosive-resistant, preferably stainless steel, preferably bolted in place. The gasket material used to seal cap of vent 120 is preferably chosen based on the type of liquid to be transported. For example, if petroleum liquid is transported then gasket material should preferably be of petroleum-grade material. Upon reading the teachings of this specification, those of ordinary skill in the art will now understand that, under appropriate circumstances, considering such issues as technology advances, material advances, galvanization process advances, etc., other vent size relationships, such as, vent-diameter-to-tank-diameter, vent-diameter-to-tank-volume, vent-diameter-to-tank-length, etc., may suffice.

Subframe 112 preferably comprises at least one end cap 117 preferably comprising at least one weep hole 118, as shown. Subframes 112 are preferably centered on the bottom of tank 102 in substantially parallel orientation, as shown. A preferred spacing A of about 34½ inches, as measured from the outside faces of subframe 112, is compatible with a number of popular vehicle chassis configurations within this size range. Upon reading the teachings of this specification, those of ordinary skill in the art will now understand that, under appropriate circumstances, considering such issues as brand/model of the transport vehicle, purpose of the tank, etc., other subframe separation distances, such as to accommodate, rail car mounting, trailer mounting, skid mounting, etc., may suffice.

Figure 3:
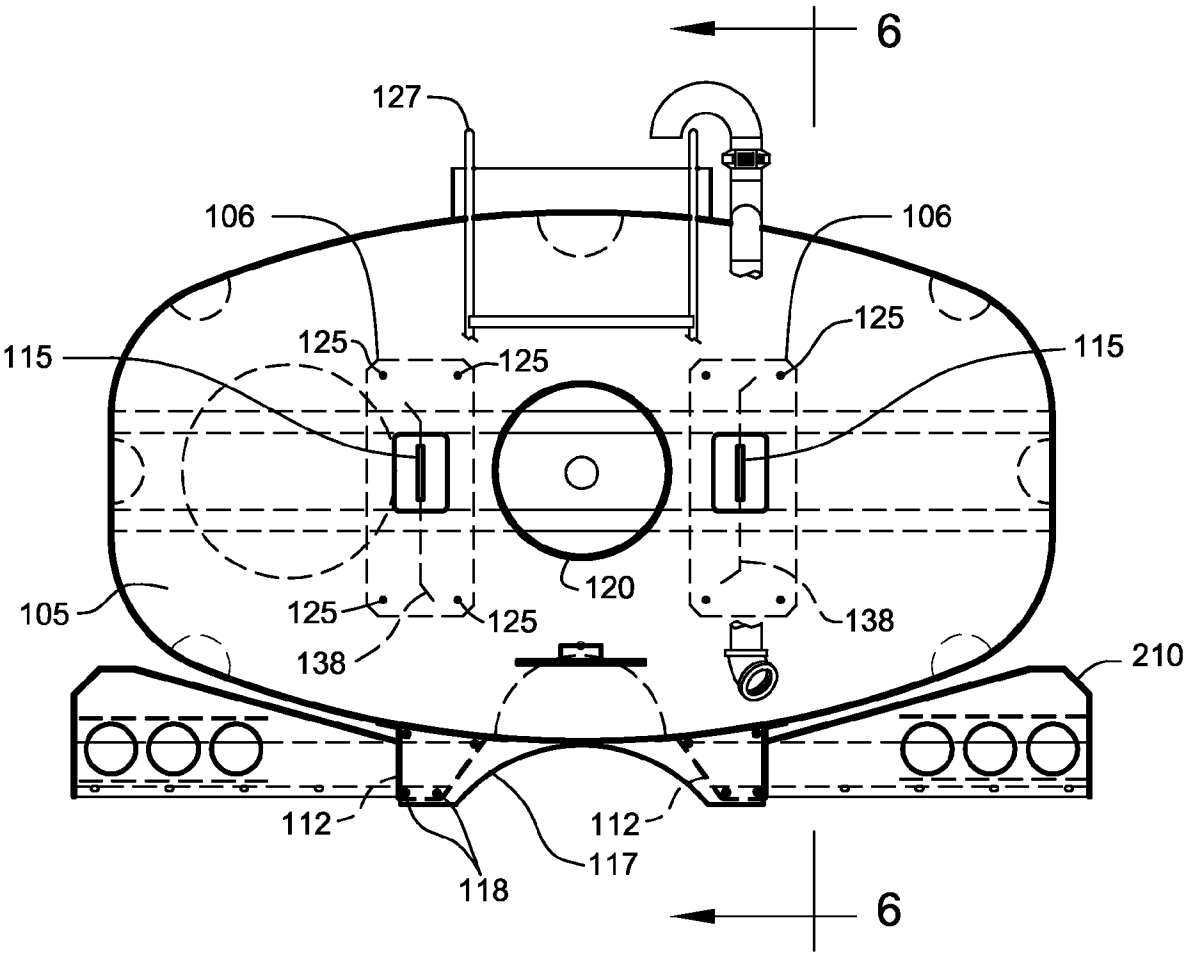
FIG. 3 shows a rear view, illustrating a rear head of the tank, according to the preferred embodiment of FIG. 1.

FIG. 3 shows a rear view illustrating rear head 105 of tank 102, according to the preferred embodiment of FIG. 1. It is noted that portions of ladder 127 and the hydrant fill pipe have been removed to better illustrate the underlying structures. Rear head 105 (at least herein embodying at least one rear containment surface structured and arranged to provide rear boundary containment of the fluids) preferably comprises at least one vent 120 (at least herein embodying wherein such at least one rear containment surface comprises at least one of such at least one first passage and such at least one second passage), at least one lifting lug 115, and at least one appurtenance pad 106, as shown. Vent 120 preferably allows galvanizing solution 133 to preferably enter and preferably exit tank 102 during hot-dip galvanizing process 132. Subframe 112 preferably comprises at least one additional end cap 117 having at least one weep hole 118, as shown.

Appurtenance pad 106 preferably comprises at least one weep hole 125 preferably allowing for air expansion and release, during hot-dip galvanizing process 132, between appurtenance pad 106 and rear head 105, as shown. Appurtenance pads 106 are preferably mounted on the interior surface of rear head 105, as shown. Appurtenance pads 106 preferably reinforce the wall of rear head 105 preferably at the points of attachment of lifting lugs 115 on the exterior of rear head 105 of tank 102 (at least herein embodying wherein such at least one rear-containment wall comprises at least one load-distributing reinforcer). Appurtenance pads 106 also preferably reinforce the wall of read head 105 preferably at the point of attachment of longitudinal baffle 138 on the interior of tank 102. Appurtenance pads 106 are preferably continuously welded to inside wall of rear head 105.

Lifting lugs 115 preferably provide attachment points preferably allowing lifting of tank 102 during hot-dip galvanizing process 132. Lifting lugs 115 are preferably continuously welded to exterior side of rear head 105.

Figure 4:
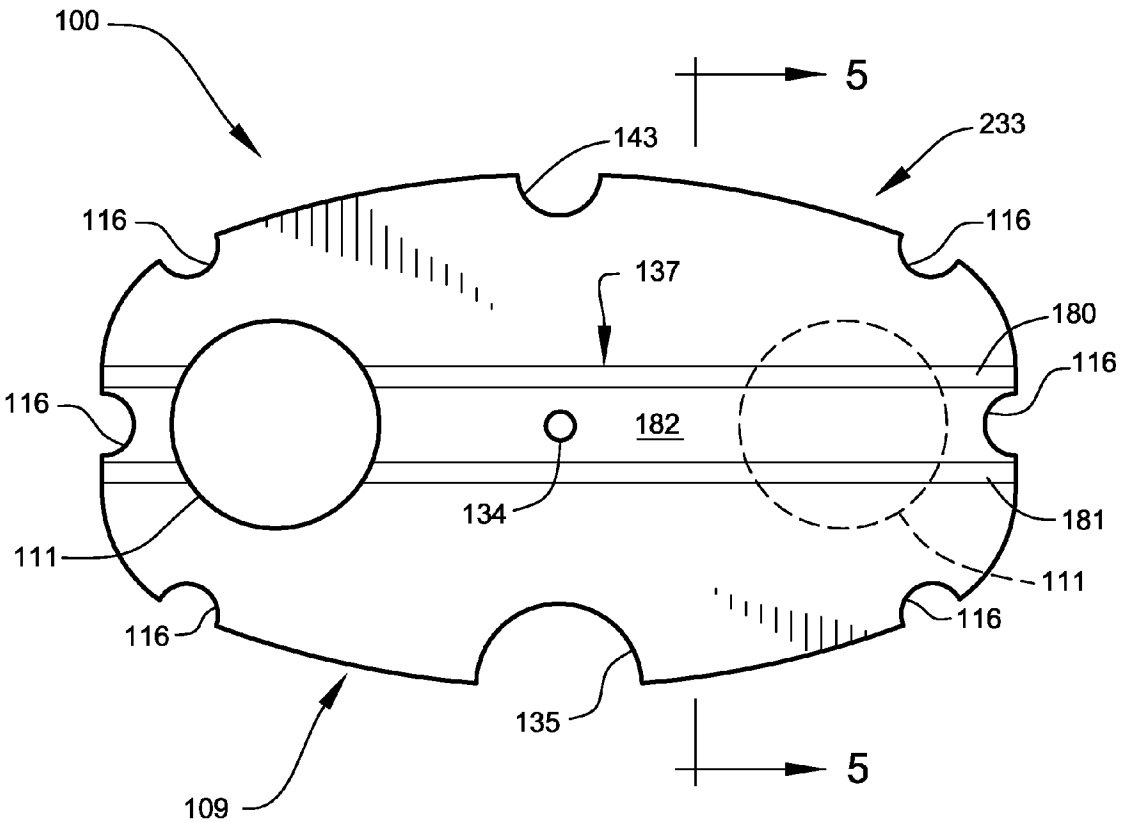
FIG. 4 shows a front view, illustrating a transverse baffle, according to the preferred embodiment of FIG. 1.

FIG. 4 shows an elevation view, illustrating transverse baffle 109, according to the preferred embodiment of FIG. 1. Transverse baffle 109 preferably comprises a primary surface plane 233 structured and arranged to control surging movements of the stored liquid in a direction generally parallel to longitudinal axis 147.

Transverse baffle 109 preferably comprises a single crawl-through hole 111, at least one circular hole 134, at least one semicircular hole 116, at least one upper semicircular hole 143, at least one offset channel 137, and at least one semicircular hole 135, as shown. In the preferred embodiments of tank system 100, crawl-through hole 111 preferably has a diameter of about 20 inches providing human access to each side of transverse baffle 109.

Semicircular hole 116, preferably of about a 3-inch radius, preferably provides for passage of galvanizing solution 133, during hot-dip galvanizing process 132, across transverse baffle 109. Semicircular hole 135, preferably of about an 18-inch radius, preferably provides for passage of galvanizing solution 133, as well as the transported liquid, across transverse baffle 109. Circular hole 134, preferably of about a 3-inch diameter, located in the center of transverse baffle 109 preferably provides for passage of galvanizing solution 133 across transverse baffle 109. Semicircular hole 143, preferably of about a 10-inch radius, preferably provides for passage of galvanizing solution 133 across transverse baffle 109. Transverse baffle 109 is preferably welded to the interior of tank 102. Transverse baffle 109 preferably functions to stiffen tank 102 and minimize forceful "sloshing" of the stored liquid during transport. Reduction of "sloshing" of the liquid during use of tank 102 preferably minimizes the potentially damaging effects associated with a heavy mass of liquid suddenly and forcefully colliding with rear head 105 or front head 119 while in transport. The second function is the overall stiffening of tank 102. Stiffening of tank 102 is particularly important both during and after hot-dip galvanizing process 132. The preferred reinforcement arrangements described herein significantly reduces deformation of tank 102 while the temperatures of the steel materials are elevated during hot dipping. After hot dipping, the steel materials are significantly more ductile (softer) due to the heat-annealing effect produced by the dipping process. Through extensive experimentation, applicant has determined that the preferred reinforcing arrangements described herein effectively maintain the shape and structural integrity of tank 102 during use.

Figure 5:
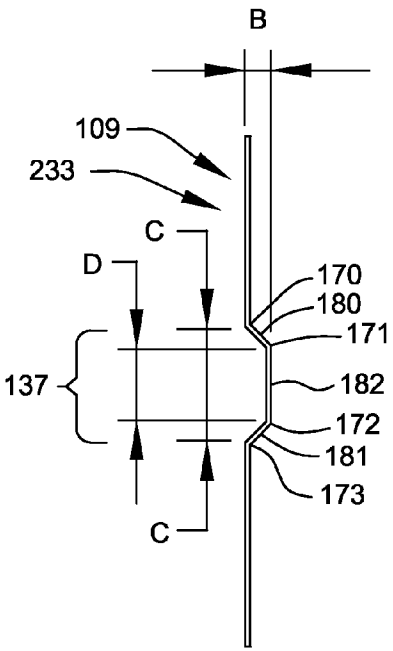
FIG. 5 shows a cross-sectional view, through the section 5-5 of FIG. 4, illustrating an offset reinforcement channel formed within the transverse baffle.

FIG. 5 shows a cross-sectional view through the section 5-5 of FIG. 4, illustrating offset channel 137 formed across transverse baffle 109. Offset channel 137 (at least embodying herein wherein such at least one transverse stiffener comprises at least one transverse channel integrally formed within such at least one transverse surge-control baffle) preferably functions to structurally stiffen transverse baffle 109 (at least herein embodying wherein such at least one transverse surge-control baffle comprises at least one transverse stiffener structured and arranged to stiffen such at least one transverse surge-control baffle). Offset channel 137 of transverse baffle 109 preferably comprises continuous break 170, continuous break 171, continuous break 172, and continuous break 173, as shown. The preferred offset depth B of offset channel 137 is approximately 2 inches. Folding of the panel forms central wall 182 preferably with two adjoining upper and lower side walls identified herein as first channel side wall 180 and second channel sidewall 181, as shown.

Central wall 182 of offset channel 137 (at least herein embodying wherein such at least one transverse channel comprises, integrally formed within such at least one surface plane; and at least herein embodying at least one offset channel wall structured and arranged to be offset from such at least one primary surface plane) has preferred height D of approximately 11 inches. Offset channel 137 preferably provides additional structural rigidity to transverse baffle 109 by preferably extending substantially the entire width of transverse baffle 109 (at least herein embodying wherein such at least one transverse channel extends substantially continuously across at least one transverse width of such at least one transverse surge-control baffle; and at least embodying herein wherein such at least one transverse surge-control baffle comprises at least one transverse stiffener structured and arranged to stiffen such at least one transverse surge-control baffle).

Break 170 and break 171 preferably form first channel side wall 180 of channel 137 (at least herein embodying extending substantially continuously from a first transverse edge of such at one offset channel wall, at least one first channel side wall). Break 172 and break 173 preferably form second channel side wall 181 of channel 137 (at least herein embodying extending substantially continuously from a second transverse edge of such at one offset channel wall, at least one second channel side wall).

First channel side wall 180 and second channel side wall 181 are preferably oriented at an obtusely-extending angle relative to central wall 182, as shown. The preferred 45-degree break angle, or complimentary obtuse angle of 135 degrees, is a key feature of the present invention, whereby, the overall efficiency of the filling and emptying of the galvanizing solution 133 during dipping is substantially improved (at least herein embodying wherein such at least one first channel side wall and such at least one second channel sidewall are each oriented at an obtusely-extending angle relative to such at least one primary surface plane). Such filling and emptying efficiency preferably helps to optimize the amount of galvanizing solution 133 used to plate tank 102.

Figure 6:
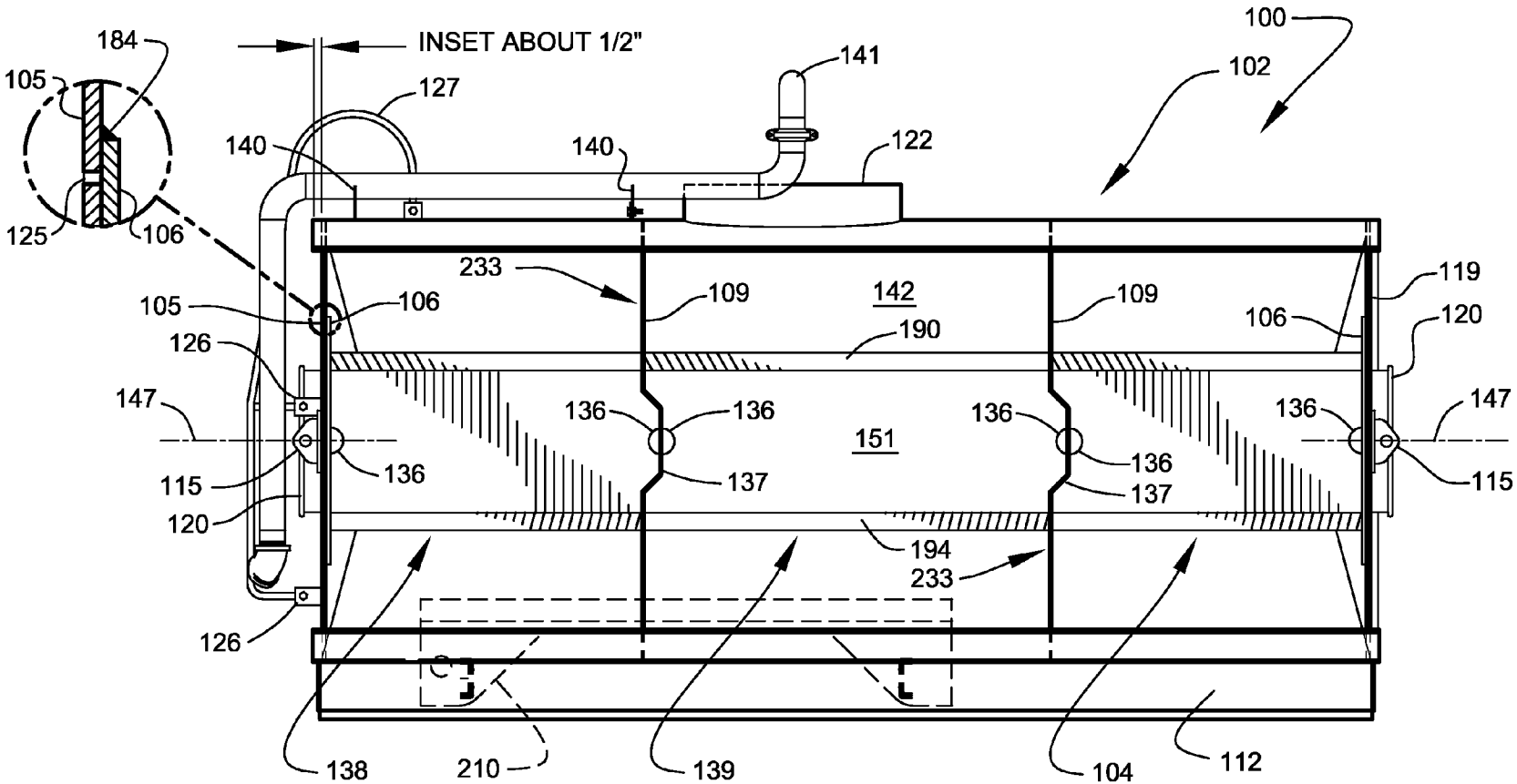
FIG. 6 shows a cross-sectional view, through the section 6-6 of FIG. 3, illustrating a preferred placement of interior baffles.

FIG. 6 shows a cross-sectional view tank 102, illustrating placement of the interior baffles, through the section 6-6 of FIG. 3. Tank 102 preferably comprises at least one transverse baffle 109, at least one longitudinal baffle 104, at least one longitudinal baffle 138, at least one longitudinal baffle 139, at least one ladder bracket 126, at least one tank wall 142 (at least herein embodying extending substantially between such at least one front containment surface and such at least one rear containment surface, at least one intermediate containment surface structured and arranged to provide intermediate interior boundary containment of the fluids), at least one pipe bracket 140, at least one rear head 105, at least one front head 119, and at least one fill inlet 122, as shown. Rear head 105 and front head 119 are preferably continuously welded preferably on both sides of the joint formed with tank 102. It is noted that tanks of longer length may preferably comprise additional transverse baffles 109 and longitudinal baffles.

Transverse baffle 109 that is closest to front head 119 is preferably placed approximately one-third the length of tank 102 from front head 119, as shown. Transverse baffle 109 that is closest to rear head 105 is preferably place approximately one-third the length of tank 102 from rear head 105, as shown. Transverse baffles 109 are preferably located in a plane that is perpendicular to longitudinal axis 147 (at least herein embodying a primary longitudinal axis oriented to intersect both such at least one front containment surface and such at least one rear containment surface). Upon reading the teachings of this specification, those of ordinary skill in the art will now understand that, under appropriate circumstances, considering such issues as technology advances, design advances, etc., other transverse baffle placements, such as, baffle locations set to a 45-degree angle, or other angles, to the longitudinal axis, etc., may suffice.

The longitudinal baffling preferably comprises at least one longitudinal baffle 104, at least one longitudinal baffle 138, and at least one longitudinal baffle 139, as shown. The longitudinal baffling preferably performs two primary functions. The first preferred function of the longitudinal baffling is to structurally couple front head 119, rear head 105, and transverse baffles 109 into a single united system. Thus, each transverse structure functions to reinforce the others. Secondarily, the longitudinal baffling functions as surge-control members during transverse movements "sloshing" of the liquid.

Figure 9:
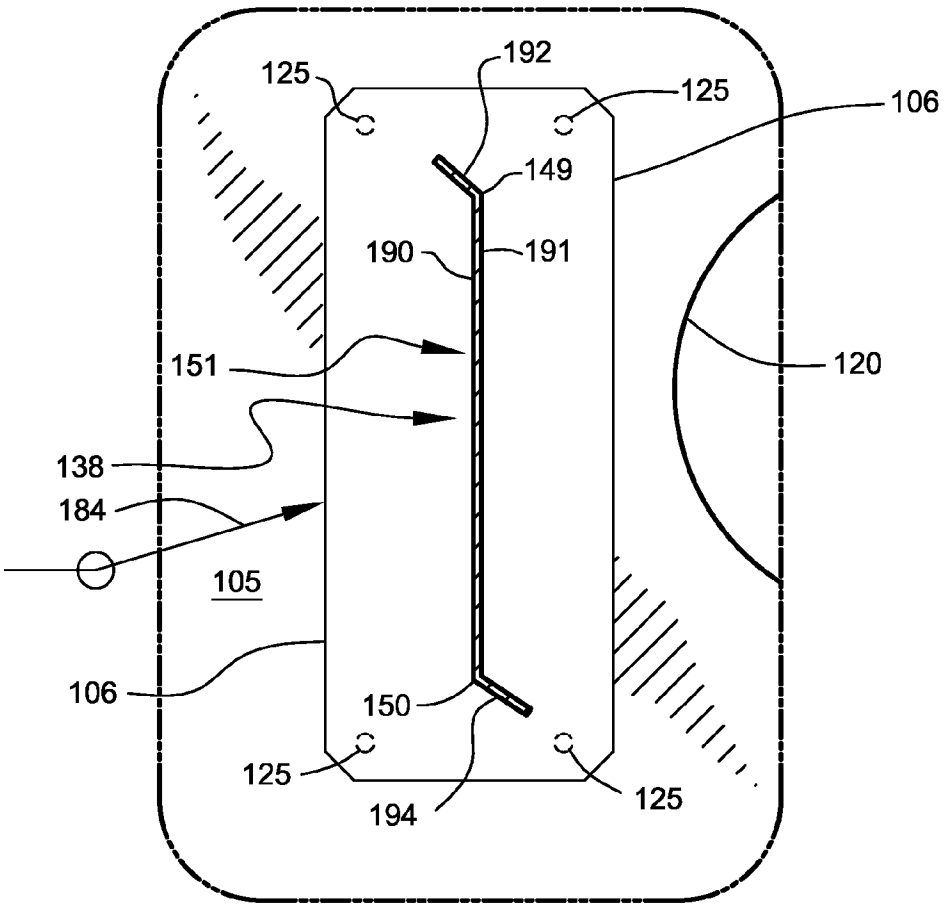
FIG. 9 shows a detail view of a longitudinal baffle on the appurtenance pad, according to the preferred embodiment of FIG. 1.

Longitudinal baffle 104, longitudinal baffle 138, and longitudinal baffle 139 each preferably comprise semicircular holes 136, preferably of about a 3-inch radius, centered in each end, designed to pass liquid. Semicircular hole 136 preferably allows the passage of galvanizing solution 133 preferably during filling and emptying cycles of hot-dip galvanizing process 132. Semicircular holes 136 preferably substantially minimize the amount of galvanizing solution 133 that is trapped between transverse baffle 109 and longitudinal baffles 104, 138, and 139 of tank 102 during hot-dip galvanizing process 132. Longitudinal baffles 104, 138, and 139 preferably function as load-distributing "reinforcer" preferably increasing the structural integrity of all transverse walls of tank 102 by distributing force loads between each of the tank walls to which they are coupled, preferably stabilizing each transverse baffle 109, rear head 105, and front head 119, as shown (at least herein embodying wherein such at least one structural stabilizer comprises at least one structural coupler structured and arranged to structurally couple such at least one transverse surge-control baffle to at least one of such at least one front containment surface and such at least one rear containment surface; and at least herein embodying wherein such at least one structural coupler is structured and arranged to structurally couple such at least one transverse surge-control baffle to both such at least one front containment surface and such at least one rear containment surface; and at least herein embodying wherein such at least one structural coupler is coupled to such at least one front-containment wall and such at least one rear-containment wall substantially through such at least one load-distributing reinforcer). Additional preferred arrangements of longitudinal baffle 104, longitudinal baffle 138, and longitudinal baffle 139 are shown in FIG. 9.

Pipe brackets 140 preferably facilitate the mounting of hydrant fill pipe 141 to tank 102 preferably after hot-dip galvanizing process 132 has been completed. Ladder brackets 126 preferably facilitate the mounting of ladder 127 to tank 102 preferably after hot-dip galvanizing process 132 has been completed. Likewise, wheel fenders 210 are bolted to tank 102 after dipping.

Rear head 105 and front head 119 are preferably inset about ½ inch from the end of tank wall 142, preferably providing substantially better weld coalescence. Liquid containment of tank 102 preferably comprises tank wall 142, rear head 105, and front head 119 (at least herein embodying wherein such at least one fluid-transport tank comprises at least one liquid-containment shell comprising at least one substantially enclosed interior portion structured and arranged to interiorly contain the fluids therein), as shown.

Figure 7:
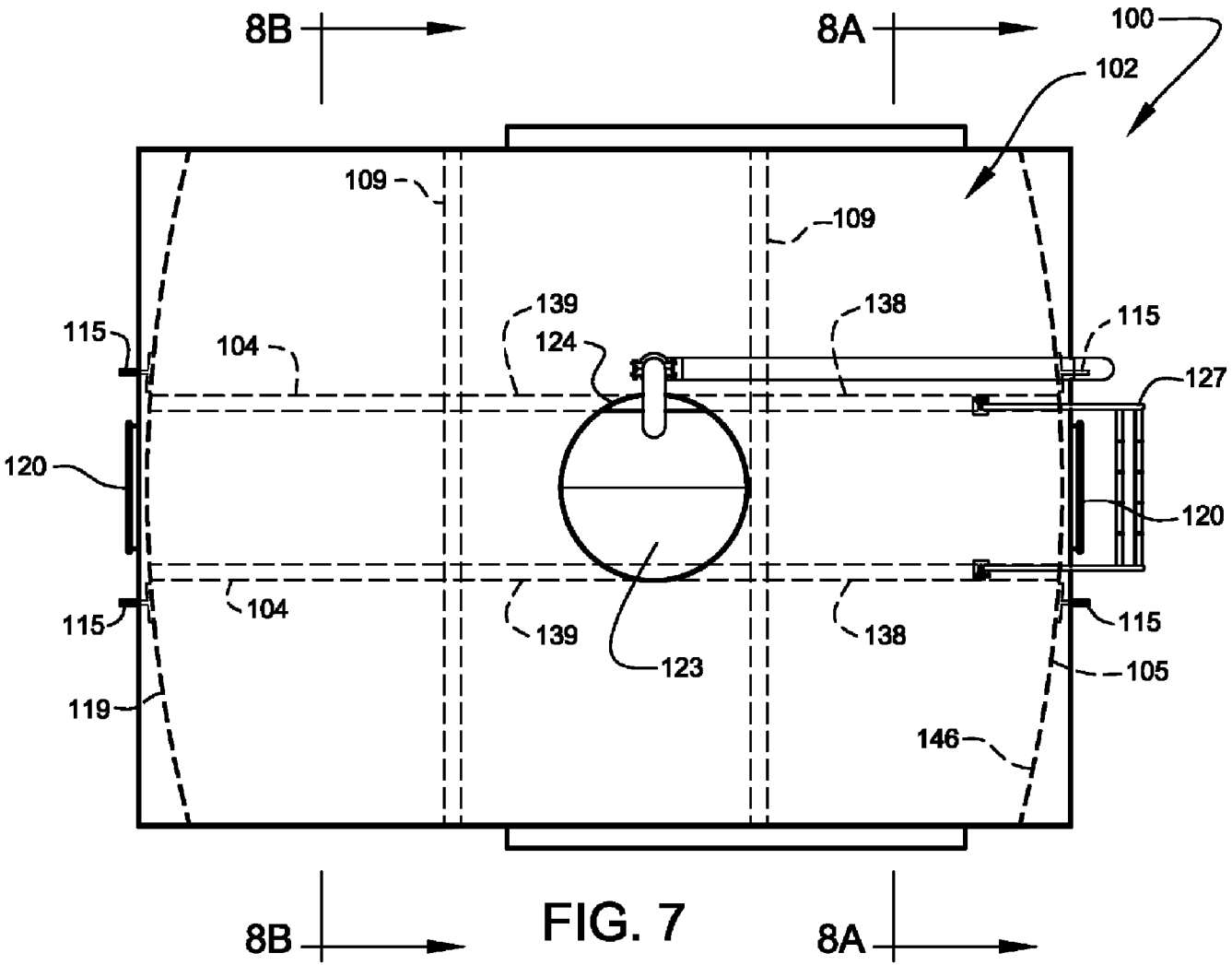
FIG. 7 shows a top view, illustrating the tank system, according to the preferred embodiment of FIG. 1.

FIG. 7 shows a top view, illustrating tank system 100, according to the preferred embodiment of FIG. 1. The preferable relative transverse concavity of rear head 105 and front head 119 is shown and has preferably a radius of about 180 inches for the depicted tank. Interior wall 146 of rear head 105 preferably curves gradually, as shown, from exterior welded edge to vent 120 preferably located at or near the center of rear head 105. Vents 120 are preferably located in rear head 105 and front head 119, as shown in FIG. 2. In the preferred example embodiment of FIG. 1, a fill inlet 122 is preferably included for ease of loading fluids for transport. Fill inlet 122 preferably comprises at least one sealable lid 123, and at least one circular neck 124. Sealable lid 123 can be preferably rotated between open and closed positions. Circular neck 124 is preferably welded and preferably extending upwards perpendicularly from tank 102.

Figure 8A:
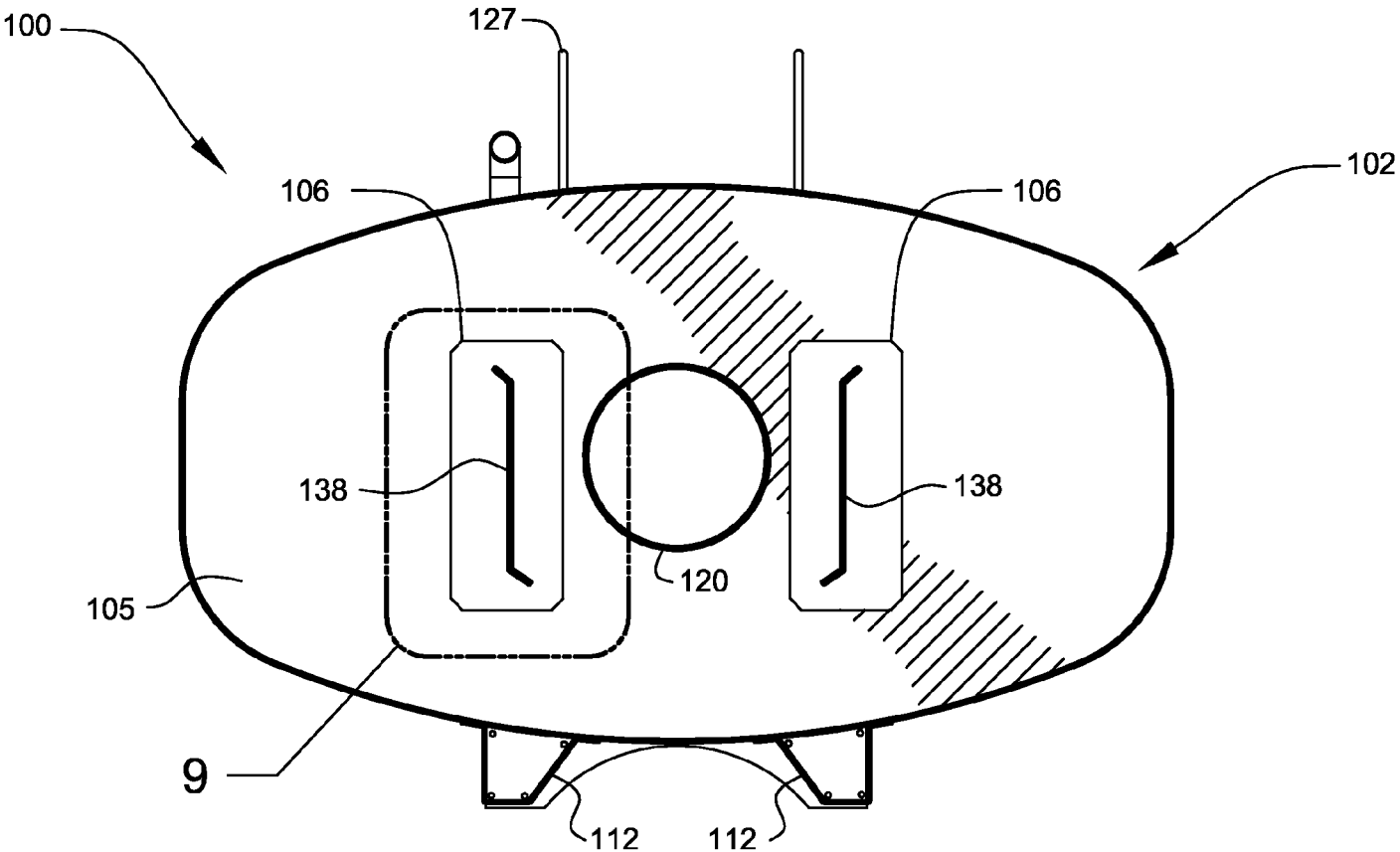
FIG. 8A shows a sectional view through the section 8A-8A of FIG. 7, illustrating placement of an appurtenance pad, according to the preferred embodiment of FIG. 1.

FIG. 8A shows a sectional view through the section 8A-8A of FIG. 1, illustrating placement of appurtenance pad 106, according to the preferred embodiment of FIG. 1. Longitudinal baffles 138 are preferably welded to an transverse baffle 109, not shown in this view, and to rear head 105 (at least herein embodying wherein such at least one structural coupler is structured and arranged to structurally couple such at least one transverse surge-control baffle to both such at least one front containment surface and such at least one rear containment surface), as shown. Longitudinal baffles 104 are preferably welded to front head 119. Where longitudinal baffles 138 are preferably welded to rear head 105, appurtenance pads 106 are included between them providing additional strength. Because of the inherent annealing of the steel that occurs during hot-dip galvanizing process 132 (at least herein embodying the step of annealing such at least one steel material to increase ductility; and at least herein embodying wherein the step of annealing such at least one steel material to increase ductility occurs during such at least partial immersion of such at least one fluid-transport tank in such at least one dip-coating-fluid), causing the metal to lose strength and increase ductility, additional support is preferably required for preventing deformation of tank 102. Longitudinal baffles 104, 139, 139, and transverse baffles 109 of tank 102 preferably control the "sloshing" effect of the liquid within a partially filled tank system 100 during transport.

Figure 8B:
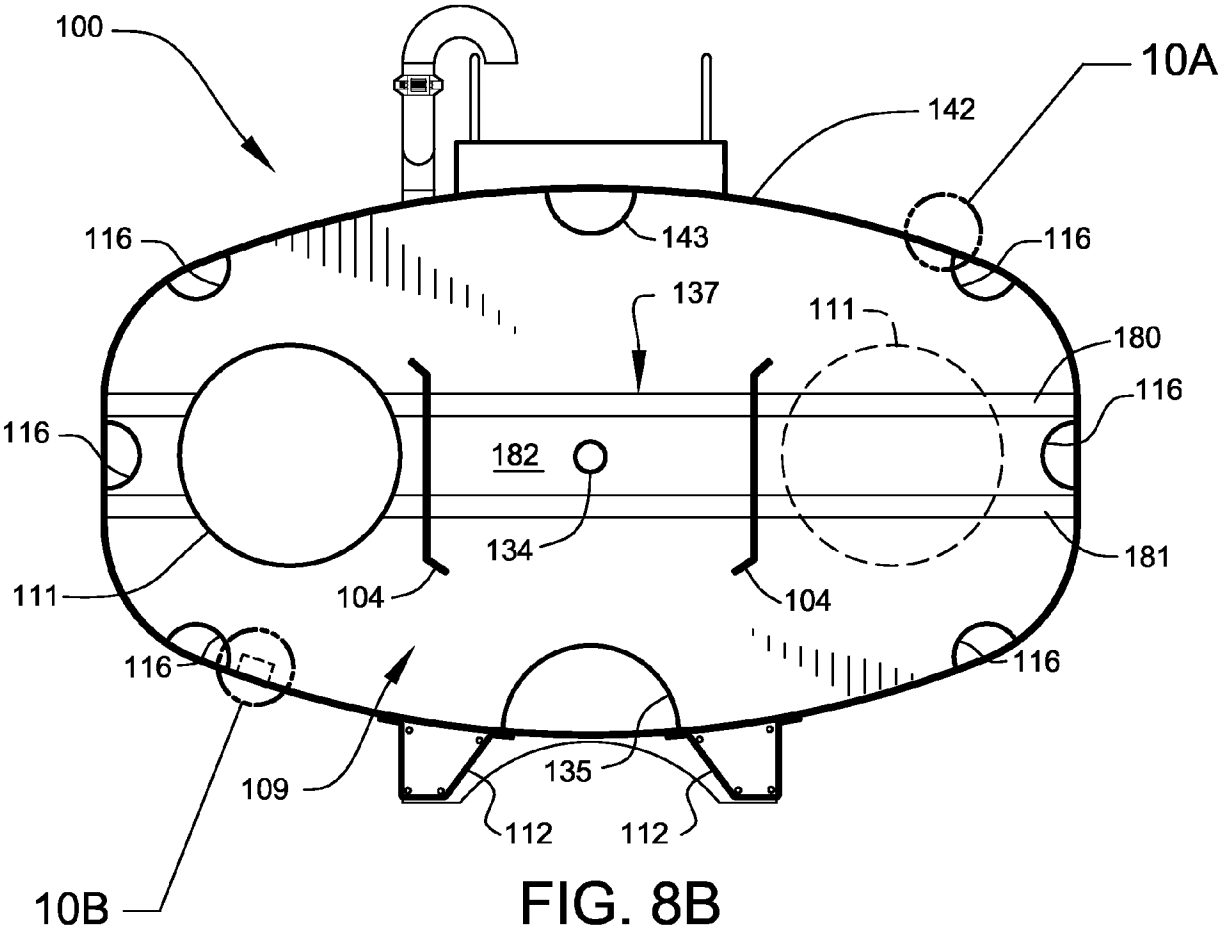
FIG. 8B shows a sectional view through the section 8B-8B of FIG. 7, illustrating an interior baffle within the interior of the tank, according to the preferred embodiment of FIG. 1.

FIG. 8B shows a sectional view through the section 8B-8B of FIG. 7, illustrating preferred placement of baffle clips 153, according to the preferred embodiment of FIG. 7. Baffle clips 153 are preferably located in a transverse plane at the longitudinal location of transverse baffle 109. Baffle clips 153 are preferably welded to tank wall 142 before transverse baffle 109 is set in place for welding. With baffle clips 153 preferably welded in place, transverse baffle 109 is preferably set onto baffle clips 153 positioning it in tank 102 for welding.

FIG. 9 shows a detail view of longitudinal baffle 138 on appurtenance pad 106, according to the preferred embodiment of FIG. 8A. Appurtenance pad 106 is preferably continuously welded to interior wall 146 of rear head 105. Longitudinal baffle 138 is preferably continuously welded to appurtenance pad 106, as shown. Weep holes 125 preferably allow for expansion of air trapped between appurtenance pad 106 and interior wall 146 preferably during welding and preferably during hot-dip galvanizing process 132.

As noted above, longitudinal baffle 104, longitudinal baffle 138, and longitudinal baffle 139 preferably function as both structural couplers and surge-controlling baffles. Longitudinal baffles (longitudinal baffle 138 will be used for illustrative purposes) preferably comprise at least one relatively tall substantially planar web plate 151 preferably functioning to attenuate sudden transverse surges of the liquids (at least herein embodying at least one web plate structured and arranged to provide such at least one surface plane). This relatively thin web plate 151 is preferably strengthened by edge reinforcements identified herein as first flange plate 192 and second flange plate 194 (at least herein embodying at least one structural stabilizer structured and arranged to structurally stabilize such at least one longitudinal surge-control baffle during such transverse movements of the liquid).

First flange plate 192 and second flange plate 194 are preferably formed from a single metal plate by at least one break 149, and at least one break 150, as shown (at least herein embodying wherein at least one portion of such at least one web plate, such at least one first flange plate, and such at least one second flange plate comprise members of at least one common structural element; and at least herein embodying wherein such at least one common structural element comprises at least one bent plate). Break 149 and break 150 are preferably bent to a preferred angle of approximately 45 degrees relative to web plate 151, as shown, the complimentary obtuse angle being approximately 135 degrees (at least herein embodying wherein such at least one stiffener comprises at least one obtuse-extender to obtusely-extend from at least one surface plane of such at least one longitudinal surge-control surface at least one substantially obtuse angle from such at least one surface plane and at least herein embodying wherein such at least one substantially obtuse angle of such at least one first flange plate and such at least one substantially obtuse angle of such at least one second flange plate each comprises an angle measurement of about 135 degrees relative to such at least one surface plane of such at least one web plate). Longitudinal baffles 138, 139 and 104 preferably have similar breaks preferably providing stiffening of the baffles (at least herein embodying at least one stiffener structured and arranged to stiffen such at least one longitudinal surge-control surface).

Web plate 151 of each longitudinal baffle is preferably substantially planar and preferably comprising first substantially planar side 190 and second substantially planar side 191 (at least herein embodying wherein such at least one web plate comprises at least one first substantially planar side at least one second substantially planar side), as shown, with one break on each side (i.e., break 149 and break 150). First flange plate 192 preferably projects upwardly from break 149 at preferably a substantially obtuse angle from first substantially planar side 190 (at least herein embodying projecting at such at least one substantially obtuse angle from such at least one first substantially planar side, at least one first flange plate structured and arranged to structurally stiffen at least one first edge portion of such at least one web plate), as shown. Second flange plate 194 preferably projects downwardly from break 149 at preferably a substantially obtuse angle from second substantially planar side 191 (at least herein embodying projecting at such least one substantially obtuse angle from at such at least one second substantially planar side, at least one second flange plate structured and arranged to stiffen at least one second edge portion of such at least one web plate), as shown. Both first flange plate 192 and second flange plate 194 are preferably structured and arranged to structurally stiffen the edge portions of web plate 151 in the transverse direction. Both first flange plate 192 and second flange plate 194 each preferably extend the full length of longitudinal baffles 138, 139, and 104 (at least herein embodying wherein such at least one first flange plate and such at least one second flange plate extend substantially along an entire linear length of such at least one web plate).

Longitudinal baffles 138 are preferably welded to an transverse baffle 109, not shown in this view, and to rear head 105 (at least herein embodying wherein such at least one structural coupler is structured and arranged to structurally couple such at least one transverse surge-control baffle to both such at least one front containment surface and such at least one rear containment surface), as shown. Because of the inherent annealing of the steel that occurs during hot-dip galvanizing process 132, causing the metal to lose strength and increase ductility, additional structural support is preferably required at the points of attachment. Where longitudinal baffles 138 are welded to rear head 105, appurtenance pads 106 are preferably included to provide additional strength.

Appurtenance pads 106 preferably function as reinforcements for rear head 105 (and front head 119) preferably at the points of attachment of lifting lugs 115 and longitudinal baffles. The peripheral edges of appurtenance pads 106 are preferably continuously welded preferably onto the interior face of rear head 105 preferably by thermal weld 184.

Figure 10B:
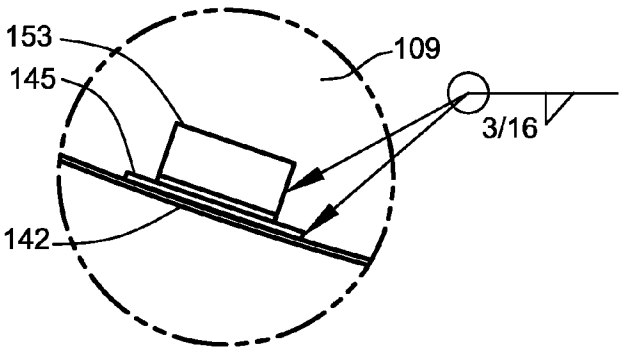
FIG. 10B shows a detail of an optional baffle clip used to secure the interior baffles to a tank wall, according to an alternate preferred embodiment the present invention.
Figure 10A:
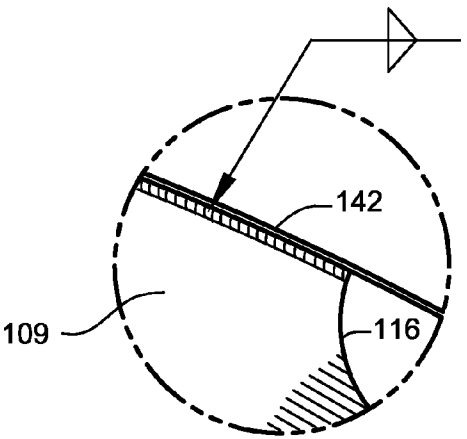
FIG. 10A shows a detail view, of a preferred welded attachment of an interior baffle to a tank wall, according to the preferred embodiment of FIG. 1.

FIG. 10A shows a detail of a preferred welded attachment of an interior baffle 109 to tank wall 142, according to the preferred embodiment of FIG. 1. The peripheral edge of interior baffle 109 is preferably continuously welded to tank wall 142 preferably using fillet welds preferably at both faces of the baffle (at least herein embodying wherein such at least one transverse surge-control baffle comprises at least one attacher structured and arranged to attach such at least one transverse surge-control baffle to interior of such at least one intermediate containment surface).

FIG. 10B shows a detail of an optional baffle clip 153 used to secure interior baffles 109 to tank wall 142, according to a less-preferred alternate embodiment the present invention. Baffle clips 153 are preferably welded to the interior of tank wall 142 preferably in a transverse plane at the preferred location where transverse baffle 109 is designed to be located, as shown. Baffle clips 153 preferably provide the support of transverse baffle 109 to locate it at the preferred location for welding. Baffle clips 153 also preferably provide extra strengthening of the connection between transverse baffle 109 and tank wall 142.

Baffle clip 153 preferably comprises at least one appurtenance pad 145 preferably continuously welded to tank wall 142. Baffle clip 153 is then preferably continuously welded to appurtenance pad 145. All baffle clips 153 are preferably located in a transverse plane at the preferred longitudinal location of transverse baffle 109.

Figure 11:
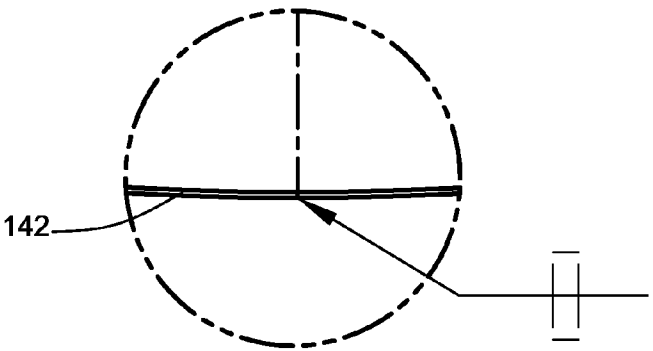
FIG. 11 shows a detail of a preferred seam used to assemble a tank wall, according to the preferred embodiment of FIG. 1.

FIG. 11 shows a detail of a preferred seam used to assemble tank wall 142, according to the preferred embodiment of FIG. 1. Butt joints of tank wall 142 are preferably double square welded, as shown.

FIG. 12 illustrates hot-dip galvanizing process 132 of tank 102, according to the preferred embodiment of FIG. 1. Hot-dip galvanizing process 132 preferably comprises at least one galvanizing solution 133, at least one kettle 130, at least one hoist chain 201, and at least one hook 202, as shown. The fully welded and uncoated mild steel tank 103 (see also tank 102 of FIG. 1) is preferably raised using cables or chains 201 with hooks 202 that are preferably coupled onto lifting lugs 115, as shown. Tank 102 is preferably gradually lowered on the end of chain 201 by its own weight into galvanizing solution 133 that preferably enters through the lower vent 120, as shown. Galvanizing solution 133 preferably flows in and around tank 102, preferably to a level at least above the midpoint of the tank (at least herein embodying providing at least partial immersion of such at least one fluid-transport tank in at least one dip-coating-fluid; and at least herein embodying providing for flow of such at least one dip-coating-fluid in to and out of such at least one fluid-transport tank). Air displaced by the flow of galvanizing solution 133 into the tank is preferably expelled through the upper vent 120. Both vents 120 are preferably sized to allow the molten fluid to freely enter and exit the raw (uncoated) tank 103, preferably in a rapid and efficient manner when lowered into and lifted from the molten galvanizing solution 133 maintained in kettle 130. The molten galvanizing solution 133 preferably cools and solidifies to form a protective coating, thus "galvanizing" tank 103 (at least herein embodying wherein such at least one liquid-containment shell further comprises such at least one protective dip-coating structured and arranged to protectively coat such at least one substantially enclosed liquid-containment shell). The half-dipped tank 103 is next rotated 180 degrees to allow the opposite (uncoated) end to be dipped. This preferably produces a fully "galvanizing" tank such as tank 102 of FIG. 1.

Vents 120, semicircular holes 116, semicircular holes 135, semicircular holes 136, and semicircular holes 143; circular hole 134; crawl-through hole 111; and longitudinal baffles 104, 139, and 138 preferably in combination allow tank system 100 to preferably be immersed quickly into galvanizing solution 133. The preferred provision of multiple paths for air and galvanizing solution 133 to move through tank 102, preferably avoiding problems related to tank buoyancy and excessive retention of galvanizing solution 133 within the assembly after dipping. Without proper venting, mild steel tank 103 (at least herein embodying wherein such at least one liquid-containment shell substantially comprises steel) would essentially float on the surface of galvanizing solution 133.

Galvanizing in practice preferably requires the immersing of clean, oxide-free mild steel into molten zinc (at least herein embodying wherein such at least one protective dip-coating substantially comprises at least one hot-dipped zinc galvanization) preferably in the form of galvanizing solution 133. This preferably forms a zinc coating layer that is a metallurgical bond to the mild steel surface. Hot-dip galvanizing process 132 preferably involves coating the mild steel of mild steel tank 103 with a thin uniform layer of zinc by preferably bathing the mild steel tank 103 in molten zinc in kettle 130 (at least herein embodying wherein such at least one dip-coating-fluid comprises molten zinc) at temperatures preferably approximating 460° Centigrade (at least herein embodying wherein such at least one dip-coating-fluid comprises a temperature of at least about 460° Centigrade).

During hot-dip galvanizing process 132, galvanizing solution 133 preferably reacts with the surface of base metal of mild steel tank 103 to form a series of zinc/iron alloy layers. Zinc carbonate preferably adheres extremely well to the underlying zinc creating protection from further corrosion. Hot-dip galvanizing process 132 is preferably used with the present invention preferably to capture the combined benefits of using inexpensive and durable mild steel with the excellent corrosion resistibility when zinc is introduced as the protective element. Hot-dip galvanizing process 132 preferably further has the additional benefit of preferably annealing the mild steel during the process because the temperature is raised, maintained at the elevated state then allowed to preferably slowly cool when removed from final dip in kettle 130.

Tank embodiments of tank systems 100 are preferably allowed to cool in ambient air. The annealing process preferably serves as a heat treatment whereby the base metal iron is altered, preferably causing changes in its properties such as hardness and strength. Annealing is preferably used to induce softness, relieve internal stresses, refine the structure, and improve cold working properties. The metal tank is preferably immersed for a specific amount of time in order to preferably allow the appropriate metallurgical reaction to take place between the zinc and iron. Preferably, the completion of the metallurgical reaction is observed when bubbling of the molten zinc in kettle 130 stops. At this point, the galvanizing is preferably complete and tank 102 is removed from kettle 130 to cool.

Applicant has determined that the results of hot-dip galvanizing process 132 used within tank systems 100 is preferably improved by the preferred designs of longitudinal baffles 104, 138, and, 139 preferably using substantially only 45-degree angled bends, thereby not trapping galvanizing solution 133 for longer periods than necessary, which would otherwise create uneven sections of heavy and light zinc coating layer within tank 102 (at least herein embodying wherein uniform flow of such at least one dip-coating-fluid is assisted by such at least one fluid-transport tank comprising such fluid-shedding baffles; and at least herein embodying whereby such at least one dip-coating-fluid is less impeded by the presence of such fluid-shedding baffles).

In a preferred method of coating tank 102, the mild steel tank 103 is preferably lowered into galvanizing solution 133 and then preferably raised up allowing a short amount of time for galvanizing solution 133 to drain out of tank 102 back into kettle 130. Tank 102 is then set down and preferably picked from lifting lugs 115 at the opposite side of tank 102. The opposite side of tank 102 is then preferably immersed so all portions of tank system 100 (at least herein embodying wherein such at least one steel material of such at least one fluid-transport tank comprises at least one substantially continuous galvanized surface after such step of providing such at least partial immersion of such at least one fluid-transport tank in such at least one dip-coating-fluid) come into contact with galvanizing solution 133 and all bare mild steel is preferably covered with zinc coating layer. Smaller versions of mild steel tank 103 are preferably dipped with rear head 105 facing up perpendicular to kettle 130 in a single dip of tank 102. Strategically placed drain holes and vents 120 preferably allows freedom of entry and exit of galvanizing solution 133 as the molten liquid displaces the air while being lowered into kettle 130. Rear head 105 preferably curves gradually, as shown, from exterior welded edge to vent 120 located at or near the center of rear head 105.

Important to the present invention are the strategically placed vents 120 (at least herein embodying wherein the step of providing for flow of such at least one dip-coating-fluid in to and out of such at least one fluid-transport tank further comprises the step of providing within such at least one fluid-transport tank, at least one fluid-transfer aperture structured and arranged to pass such at least one dip-coating-fluid into and out of such at least one fluid-transport tank and at least one pressure-equalization vent structured and arranged to promote the equalization of pressure between an interior of and an exterior of such at least one fluid-transport tank during such at least one partial immersion) preferably in combination with the concaved rear head 105 and the orientation angles of baffles 104. This unique combination preferably works to facilitate the rapid and even filling and draining of galvanizing solution 133 when tank system 100 is lowered into and lifted from kettle 130. At a later point, when galvanizing solution 133 has air cooled, vents 120 are preferably sealed with flanges or other means for covering the openings. Exterior features such as fenders, ladders, mud flaps and other sub-assemblies or parts are preferably galvanized separately from the tank structure and then are preferably mechanically fastened to pre-welded mount points.

Figure 13:
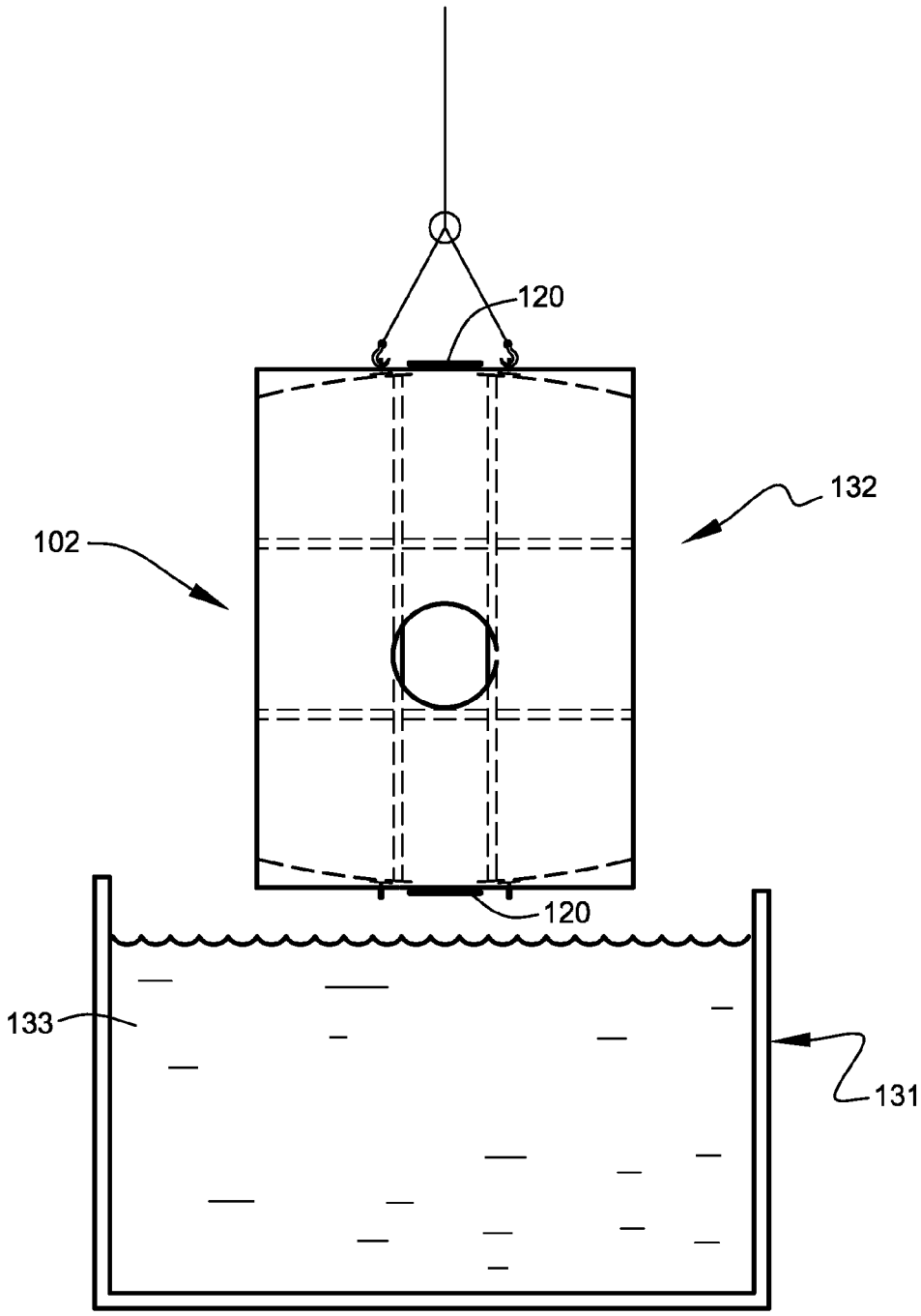
FIG. 13 shows a hot-dip galvanizing process while withdrawing the tank, according to the preferred embodiment of FIG. 1.

FIG. 13 shows hot-dip galvanizing process 132 while withdrawing tank 102, according to the preferred embodiment of FIG. 1. Tank 102 is preferably lifted from galvanizing solution 133; galvanizing solution 133 preferably exits tank 102 through the lower vent 120. Preferred locating of vents 120 at both ends of tank 102 enables air to freely enter and exit replacing the volume of galvanizing solution 133 as it is lifted from the molten galvanizing solution 133.

Preferably, when tanks 102 are longer than twice the depth of kettle 130, the length of kettle 130 is made longer than tank 102 to be dipped. Tank 102 of long length is preferably dipped in bottom first, and then turned over preferably allowing the top to be dipped. A different configuration of vents 120 is preferred when tank 102 is dipped bottom first. Vents 120 are preferably placed on the bottom side of tank 102 instead of in front head 119 and rear head 105.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A method, relating to dip-coating of at least one fluid-transport tank having fluid-shedding baffles that do not substantially retain fluid, comprising the steps of:

a) providing at least partial immersion of such at least one fluid-transport tank in at least one dip-coating-fluid;

b) providing for flow of such at least one dip-coating-fluid in to and out of such at least one fluid-transport tank;

c) wherein uniform flow of such at least one dip-coating-fluid is assisted by such at least one fluid-transport tank comprising such fluid-shedding baffles; and d) whereby such at least one dip-coating-fluid is less impeded by the presence of such fluid-shedding baffles.

2. The method according to claim 1 wherein:

a) such at least one fluid-transport tank is constructed substantially from at least one steel material; and b) such at least one steel material of such at least one fluid-transport tank comprises at least one substantially continuous galvanized surface after such step of providing such at least partial immersion of such at least one fluid-transport tank in such at least one dip-coating-fluid.

3. The method according to claim 2 further comprising the step of completing welding of such at least one fluid-transport tank prior to the step of providing such at least partial immersion of such at least one fluid-transport tank in such at least one dip-coating-fluid.

4. The method according to claim 3 further comprising the step of annealing such at least one steel material to increase ductility.

5. The method according to claim 4 wherein:

a) the step of annealing such at least one steel material to increase ductility occurs during such at least partial immersion of such at least one fluid-transport tank in such at least one dip-coating-fluid; and b) such at least one dip-coating-fluid comprises molten zinc.

6. The method according to claim 2 wherein such at least one dip-coating-fluid comprises a temperature of at least about 460° Centigrade.

7. The method according to claim 1 wherein the step of providing for flow of such at least one dip-coating-fluid in to and out of such at least one fluid-transport tank further comprises the step of providing within such at least one fluid-transport tank, at least one fluid-transfer aperture structured and arranged to pass such at least one dip-coating-fluid into and out of such at least one fluid-transport tank and at least one pressure-equalization vent structured and arranged to promote the equalization of pressure between an interior of and an exterior of such at least one fluid-transport tank during such at least one partial immersion.

8. The method according to claim 1 further comprising the step of providing at least one reinforced lift point structured and arranged to assist reinforced lifting of such at least one fluid-transport tank during such at least partial immersion.

* * * * *